US007432866B2

(12) United States Patent
Cheng et al.

(10) Patent No.: US 7,432,866 B2
(45) Date of Patent: Oct. 7, 2008

(54) ANTENNA DEVICE WITH ION-IMPLANTED RESONANT PATTERN

(75) Inventors: Yu-Chiang Cheng, Taipei (TW); Ping-Cheng Chang, Chaozhou Town, Pingtung County (TW); Cheng-Zing Chou, Xinying (TW)

(73) Assignee: Mitac Technology Corp., Hsin-Chu Hsien (TW)

( * ) Notice: Subject to any disclaimer, the term of this patent is extended or adjusted under 35 U.S.C. 154(b) by 151 days.

(21) Appl. No.: 11/404,812

(22) Filed: Apr. 17, 2006

(65) Prior Publication Data

US 2007/0216581 A1 Sep. 20, 2007

(30) Foreign Application Priority Data

Mar. 14, 2006 (TW) ..... 95108651 A

(51) Int. Cl.
*H01Q 1/38* (2006.01)
*H01Q 21/00* (2006.01)

(52) U.S. Cl. ..... 343/702; 343/702; 343/816; 343/817; 343/814; 343/820

(58) Field of Classification Search ..... 343/716, 343/717

See application file for complete search history.

(56) References Cited

U.S. PATENT DOCUMENTS

| | | | | |
|---|---|---|---|---|
| 6,046,703 | A * | 4/2000 | Wang et al. | 343/795 |
| 6,052,098 | A * | 4/2000 | Killen et al. | 343/795 |
| 6,326,922 | B1 * | 12/2001 | Hegendoerfer | 343/700 MS |
| 7,156,841 | B2 * | 1/2007 | Berube | 606/33 |
| 7,173,568 | B2 * | 2/2007 | Kanazawa | 343/702 |
| 7,259,722 | B2 * | 8/2007 | Strauss et al. | 343/702 |
| 7,345,640 | B2 * | 3/2008 | Watari et al. | 343/713 |
| 2007/0216582 | A1 * | 9/2007 | Cheng et al. | 343/702 |

* cited by examiner

*Primary Examiner*—Trinh V Dinh
(74) *Attorney, Agent, or Firm*—Rosenberg, Klein & Lee

(57) ABSTRACT

Disclosed is an antenna device having a substrate, an antenna element for transceiving a wireless signal, an antenna signal feeding line for feeding the wireless signal, and an ion-implanted resonant pattern, which includes a first coupling pattern implanted in the substrate by an Ion-implantation process and a second coupling pattern formed at a position corresponding to the first coupling pattern with a predetermined distance therebetween, formed at an adjacent position with respect to the antenna element. As the antenna element transceives the wireless signal of the predetermined radiation frequency and generates an induction voltage, the first coupling pattern and the second coupling pattern each generates a coupled induction voltage and a capacitance therebetween, hence forming a resonance with the antenna element.

14 Claims, 3 Drawing Sheets

ANTENNA DEVICE WITH ION-IMPLANTED RESONANT PATTERN

FIELD OF THE INVENTION

The present invention relates to an antenna device with a resonant pattern, and in particular to an antenna device with an ion-implanted resonant pattern.

BACKGROUND OF THE INVENTION

It is well known that an antenna is the key element to transmit/receive (transceive) microwaves in wireless technology such as wireless communication and wireless data transfer, where the antenna converts electrical currents generated by a transmitter into microwaves and transmits the microwaves in free space. The antenna also captures microwaves and converts them into electrical currents, which are then processed by a receiver. As a result, the characteristics of the antenna deeply affect that of the wireless technology, and the antenna can be referred as the index to examine the quality of the wireless technology.

Currently, antennas of conventional use are required with specific dimensions, and only the antennas with the required dimension optimize the feeding and transceiving of wireless signals. Many of those skilled in the art, therefore, utilize a resonant circuit to resonant with the antenna in order to magnify the electrical current fed to and transceived by the antenna, so as to reduce the noise and enhance the gain of the antenna to upgrade the quality of the wireless technology.

Please refer to FIG. 1 that shows a conventional use of a resonant circuit applied to the antenna. As shown in the figure, an antenna 1 couples with a resonant circuit 2, which is composed of an inductance 21 and a capacitor 22, in order to magnify the electrical current fed to and transceived by the antenna 1. As the antenna element 1 transceives the wireless signal of the predetermined radiation frequency and generates an induction voltage V1, the inductance 21 and the capacitor 22 each generates a coupled induction voltage V2 and a capacitance therebetween. As a consequence, the inductance 21 and the capacitor 22 form a resonance with the antenna element.

Although some of the conventionally used electronic devices with antennas in the market are accompanied with resonant circuits to upgrade the quality of the transceiving of the wireless signals, the resonant circuits are in fact individually manufactured and then arranged in the electronic devices and electronically connected to the antenna. Such manufacturing is not only troublesome bust also increases costs.

SUMMARY OF THE INVENTION

A primary object of the present invention, therefore, is to provide an antenna device with an ion-implanted resonant pattern, which functions the same as a resonant circuit. Further objects of the present invention are to provide a resonant pattern co-structured with an electronic device and a resonant pattern capable of resonating with an antenna.

To realize the above objects, the present invention installs an antenna device having a substrate, an antenna element for transceiving a wireless signal, an antenna signal feeding line for feeding the wireless signal, and an ion-implanted resonant pattern, which includes a first coupling pattern implanted in the substrate by an Ion-implantation process and a second coupling pattern formed at a position corresponding to the first coupling pattern with a predetermined distance therebetween, formed at an adjacent position with respect to the antenna element. As the antenna element transceives the wireless signal of the predetermined radiation frequency and generates an induction voltage, the first coupling pattern and the second coupling pattern each generates a coupled induction voltage and a capacitance therebetween, hence forming a resonance with the antenna element.

In the preferred embodiment of the present invention, the substrate is a casing of an electronic device, and the antenna element is arranged on an inner surface of the casing. In addition, the second coupling pattern is implanted in the casing of the electronic device by the process of Ion-implantation as well.

In comparison with the conventional technologies, which the resonant patterns are in fact individually manufactured and then arranged on a base or an inner surface in the electronic devices, the present invention implants an resonant pattern inside the structure of an electronic device by applying the process of Ion-implantation. Besides, the electronic device co-structured and ion-implanted resonant pattern magnifies the electrical current fed to and transceived by the antenna, as well as reduces the noise and enhances the gain of the antenna to upgrade the quality of the wireless technology. Further, the present invention can be adapted into a wide range of electronic devices when used in different fields of application.

These and other objects, features and advantages of the invention will be apparent to those skilled in the art, from a reading of the following brief description of the drawings, the detailed description of the preferred embodiment, and the appended claims.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
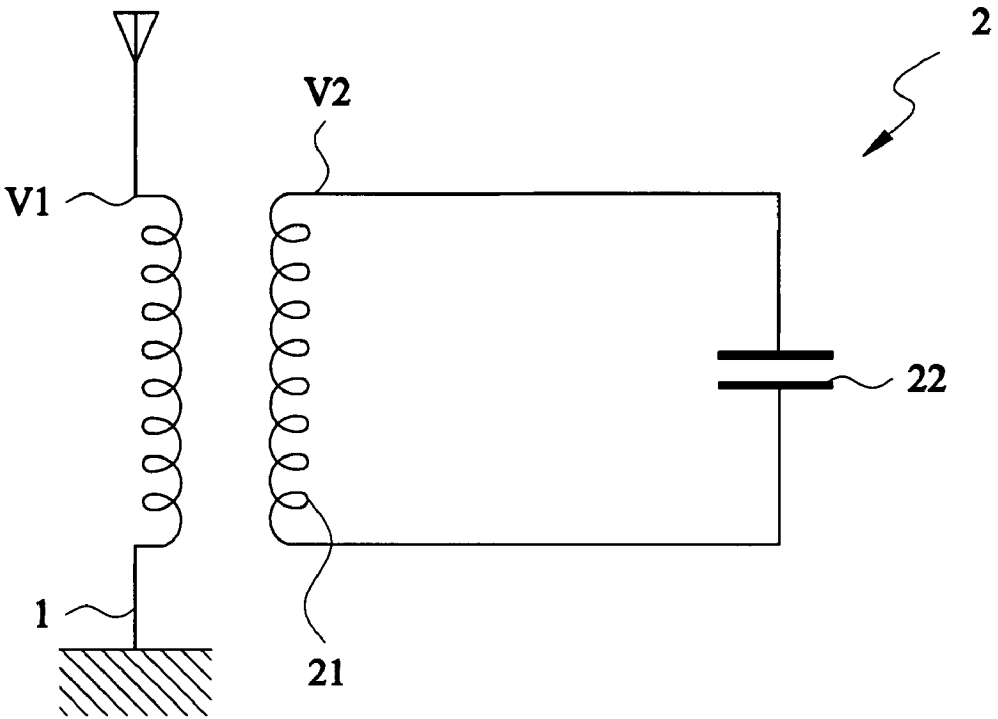
FIG.1(Prior Art)
FIG. 1 shows the conventional use of a resonant circuit applied to an antenna.
Figure 2:
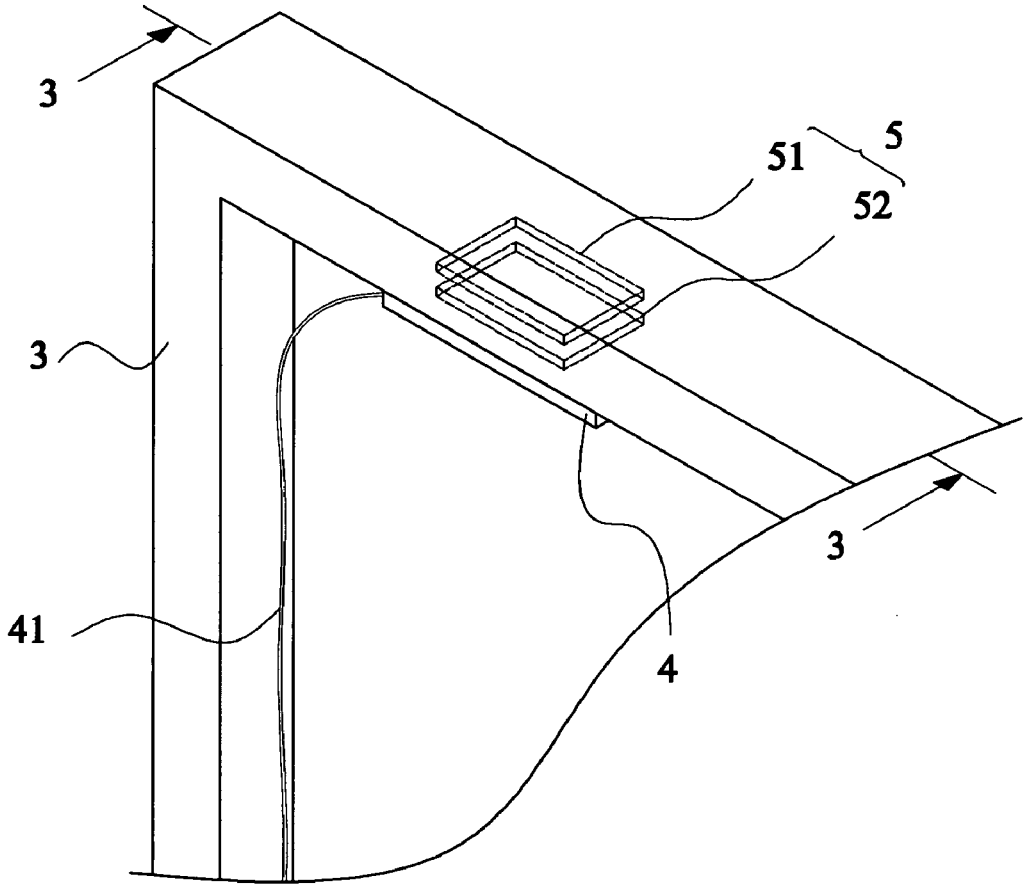
FIG. 2 is an assembled perspective view of an antenna device with an ion-implanted resonant pattern in accordance with the preferred embodiment of the present invention.
Figure 3:
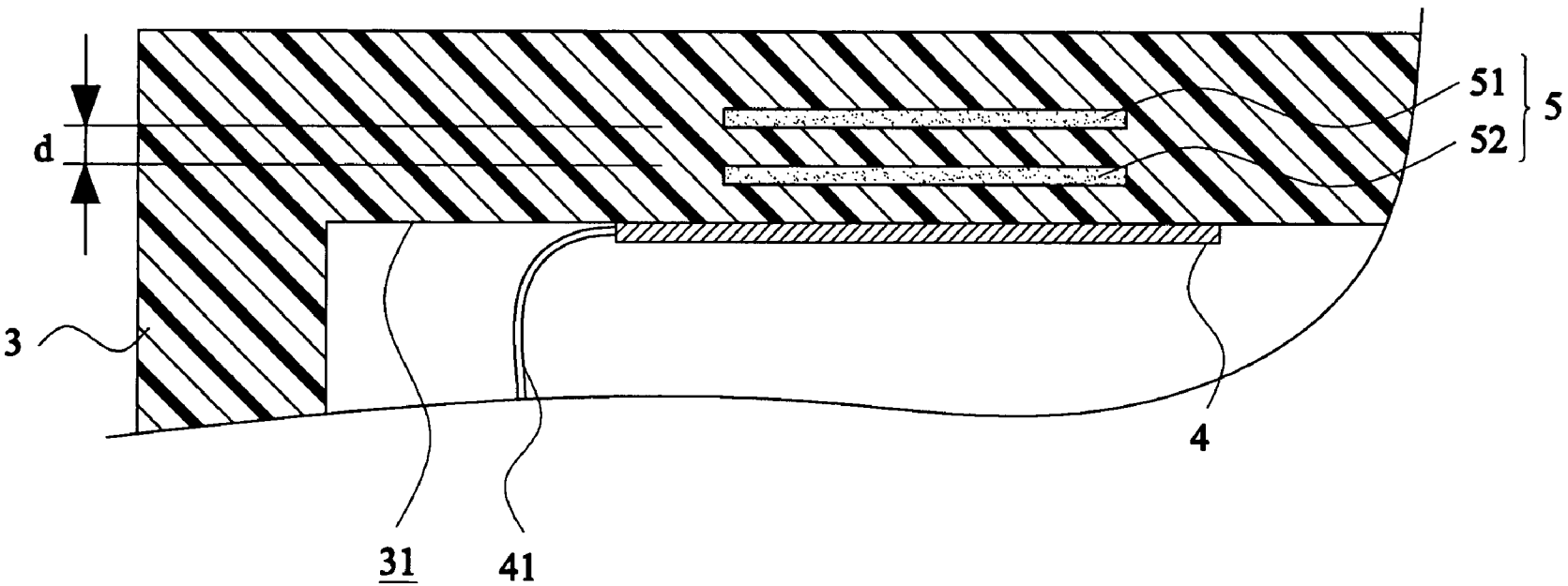
FIG. 3 is a sectional view taken along line 3-3 of FIG. 2.

With reference to the drawings FIGS. 2 and 3 that is an assembled perspective view of an antenna device with an ion-implanted resonant pattern in accordance with the preferred embodiment of the present invention and a sectional view taken along line 3-3 of FIG. 2, a substrate 3 of an electronic device (not shown in the figure) includes an antenna element 4, which is electrically connected to an antenna module (also not shown in the figure) of the electronic device by an antenna signal feeding line 41, for transceiving a wireless signal of a predetermined radiation frequency.

In the preferred embodiment of the present invention, the substrate 3 could be a casing of the electronic device, and the material of the substrate 3 could be either air, metal, or plastic in accordance with the different fields of application of the antenna element 4. Further, the connection between the antenna element 4 and the antenna signal feeding line 41 could be either direct wire connection, coupling feeding, or any other method capable of feeding and conducting signals between the antenna module and the antenna element 4.

In addition, the antenna element 4 is arranged on an inner surface 31 of the substrate 3, and the wireless signal received by the antenna element 4 from free space is conducted to the antenna module by the antenna signal feeding line 41, while the wireless signal generated by the antenna module is also conducted to the antenna element 4 by the antenna signal feeding line 4.

The substrate 3 further includes an ion-implanted resonant pattern 5 that includes a first coupling pattern 51 and a second coupling pattern 52 arranged at a position corresponding to the first coupling pattern with a predetermined distance d therebetween, both of which are implanted at an adjacent position with respect to the antenna element 4 in the substrate 3 by an process of Ion-implantation. Moreover, the forming inside the substrate 3 of the first and second coupling pattern 51 and 52 is able to adapt any process other than Ion-implantation in accordance with the application fields of the antenna element.

As the antenna element 4 transceives the wireless signal of the predetermined radiation frequency and generates an induction voltage V1, each of the first coupling pattern 51 and the second coupling pattern 52 generates a coupled induction voltage and generates a capacitance therebetween. As a consequence, the first and second coupling pattern 51 and 52 form a resonance with the antenna element 4, hence magnify the electrical current fed to and transceived by the antenna element 4, so as to reduce the noise and enhance the gain of the antenna element 4 in order to enhance the capability of the transceiving of the wireless signal.

In the preferred embodiment of the present invention, the forming of the ion-implanted resonant pattern 5 in the substrate 3 is by the process of Ion-implantation, which atoms or molecules are ionized, accelerated in an electric field and implanted into the target material (the substrate 3 in the present invention.) The first and second coupling patterns 51 and 52, therefore, each can be arranged at a desired position and depth in the substrate 3 or have the desired structure and dimension in accordance the different fields of application.

With the preferred embodiment stated above, the present invention directly implants resonant patterns inside the structure of an electronic device by applying the process of Ion-implantation. Besides, the electronic device co-structured and ion-implanted resonant pattern magnifies the electrical current fed to and transceived by the antenna, so as reduces the noise and enhances the gain of the antenna to upgrade the quality of the wireless technology. Further, the present invention can be adapted into a wide range of electronic devices when used in different fields of application.

While the invention has been described in connection with what is presently considered to the most practical and preferred embodiments, it is to be understood that the invention is not to be limited to the disclosed embodiments, but on the contrary, is intended to cover various modifications and equivalent arrangement included within the spirit and scope of the appended claims.

What is claimed is:

1. An antenna device, comprising:

a substrate;

an antenna element arranged at a predetermined position of the substrate for transceiving a wireless signal of a predetermined radiation frequency;

an antenna signal feeding line coupling to the antenna element for feeding the wireless signal transceived by the antenna element; and a resonant pattern insulated from the antenna element and disposed adjacent thereto, comprising:

a first coupling pattern embedded within the substrate; and a second coupling pattern formed at a position corresponding to the first coupling pattern a predetermined distance to be insulated therefrom;

wherein when the antenna element transceives the wireless signal of the predetermined radiation frequency and generates an induction voltage, the first coupling pattern and the second coupling pattern each generates a coupled induction voltage and a capacitance therebetween, hence forming a resonance with the antenna element.

2. The antenna device as claimed in claim 1, wherein the first coupling pattern comprises a metallic material.

3. The antenna device as claimed in claim 1, wherein the antenna signal feeding line is directly connected to the antenna element.

4. The antenna device as claimed in claim 1, wherein the second coupling pattern is implanted in the substrate by the Ion-implantation process.

5. The antenna device as claimed in claim 4, wherein the second coupling pattern comprises a metallic material.

6. The antenna device as claimed in claim 1, wherein the substrate is a casing of an electronic device.

7. The antenna device as claimed in claim 1, wherein the antenna element is arranged on an inner surface of the substrate.

8. The antenna device as claimed in claim 1, wherein the first coupling pattern is implanted in the substrate by the Ion-implantation process.

9. A resonant pattern formed in a substrate of an antenna device and at an adjacent position with respect to an antenna element of the antenna device, comprising:

a first coupling pattern embedded within the substrate; and second coupling pattern formed at a position corresponding to the first coupling pattern a predetermined distance to be insulated therefrom therefrom; wherein the first and second coupling patterns being insulated from the antenna element, and when the antenna element transceives a wireless signal of a predetermined radiation frequency and generates an induction voltage, the first coupling pattern and the second coupling pattern each generates a coupled induction voltage and a capacitance therebetween, hence forming a resonance with the antenna element.

10. The antenna device as claimed in claim 9, wherein the first coupling pattern comprises a metallic material.

11. The antenna device as claimed in claim 9, wherein the second coupling pattern is implanted in the substrate by the Ion-implantation process.

12. The antenna device as claimed in claim 11, wherein the second coupling pattern comprises a metallic material.

13. The antenna device as claimed in claim 9, wherein the substrate is a casing of an electronic device.

14. The antenna device as claimed in claim 9, wherein the first coupling pattern is implanted in the substrate by the Ion-implantation process.

* * * * *